United States Patent [19]

Kato et al.

[11] Patent Number: 4,948,426

[45] Date of Patent: Aug. 14, 1990

[54] SINTERING METAL POWDER AND A PROCESS FOR MAKING A SINTERED METAL PRODUCT

[75] Inventors: Yutaka Kato, Tachikawa; Yoshio Kijima, Setagaya, both of Japan

[73] Assignee: Sumitomo Metal Mining Company Limited, Japan

[21] Appl. No.: 468,274

[22] Filed: Jan. 22, 1990

[30] Foreign Application Priority Data

Oct. 17, 1989 [JP] Japan ..... 1-269730

[51] Int. Cl.[5] ..... B22F 1/00

[52] U.S. Cl. ..... 419/23; 75/252; 75/228; 419/36; 419/37; 419/38; 419/39; 419/57; 419/53; 419/54

[58] Field of Search ..... 75/251, 252, 255; 419/36, 37

[56] References Cited

U.S. PATENT DOCUMENTS 4,483,905 11/1984 Engström ..... 428/570

4,602,953 7/1986 Wiech, Jr. ..... 75/228

4,716,019 12/1987 Houck et al. ..... 419/17

*Primary Examiner*—Stephen J. Lechert, Jr.

*Assistant Examiner*—Leon Nigohosian

*Attorney, Agent, or Firm*—Watson, Cole, Grindle & Watson

[57] ABSTRACT

A sintering metal powder consisting of metal particles having a particle diameter distribution including a plurality of peaks. The larger of the two particle diameters at every adjoining two, respectively, of the peaks has a ratio of between 5 and 10 to the smaller. The height of one of every adjoining two of the peaks has a ratio of between 1 and 5 to that of the other that is not higher than the one peak. The particle diameter at one of every adjoining two of the peaks which is not higher than the other is smaller than that at the other peak. The particle diameter at the highest peak is between 30 and 80 microns. A process for making a sintered product from such a powder is also disclosed.

13 Claims, 1 Drawing Sheet

SINTERING METAL POWDER AND A PROCESS FOR MAKING A SINTERED METAL PRODUCT

BACKGROUND OF THE INVENTION

1. Field of the Invention:

This invention relates to a metal powder used for making a sintered metal product, particularly one which is mixed with a binder to form a composition to be formed by injection molding or otherwise into an intermediate molded product to be sintered, and to a process for making a sintered metal product.

2. Description of the Prior Art:

It has hitherto been usual to make a sintered metal product by pressing a metal powder to form a compacted body and sintering it. It has, however, been very difficult to make by such a process any sintered product having a complicated three-dimensional shape, a reduced wall thickness, or a knife edge.

Modified processes have been proposed to overcome the difficulty as hereinabove stated. According to the disclosure of U.S. Pat. Nos. 4,197,118, 4,305,756, 4,404,166, 4,415,528, 4,445,936, 4,602,953, 4,765,950, a mixture comprising a metal powder having an average particle diameter not exceeding 10 microns and an appropriate binder is formed by injection molding or otherwise into an intermediate molded product, the binder is removed from it by heating or solvent extraction, and the intermediate product is sintered. These processes can make a product having a high sintered density. They, however, have a number of drawbacks, too, as they require the use of a large amount of binder. The removal of the binder requires a long time. The heavy shrinkage of the material which occurs when it is sintered results in a sintered product having a low degree of dimensional accuracy. Moreover, the mixture which is employed is expensive.

The economical disadvantage as hereinabove pointed out can be improved by the use of a metal powder having an average particle diameter exceeding 10 microns. It, however, presents a number of problems, too. Such a powder yields a product having a low sintered density. Its mixture with a binder is less easy to mold by injection or otherwise into an intermediate product. Moreover, the intermediate product lowers its strength and even fails to retain its shape, when the binder is removed from it.

SUMMARY OF THE INVENTION

Under these circumstances, it is an object of this invention to provide an improved sintering metal powder which enables the economical and efficient manufacture of a sintered metal product having a high dimensional accuracy and a high density from an injection or otherwise molded intermediate product of a mixture of the powder and a binder.

This object is attained by a metal powder consisting of metal particles having a particle diameter distribution including a plurality of peaks and having the following characteristics:

(a) The larger of the two particle diameters defining every adjoining two of said peaks has a ratio of between 5 and 10 to the smaller;

(b) The height of one of every adjoining two of said peaks has a ratio of between 1 and 5 to that of the other that is not higher than said one peak;

(c) The particle diameter defining one of every adjoining two of said peaks which is not higher than the other is smaller than that defining said other peak; and (d) The particle diameter defining the highest of said peaks is between 30 and 80 microns.

Injection molding is the most suitable method for preparing an intermediate molded product from the metal powder of this invention. It is, however, possible to use another method, such as powder extrusion, slip casting, compression molding, hydrostatic molding, roll molding, or doctor blade molding, for preparing an intermediate molded product from the powder of this invention.

A mixture of the powder of this invention with a binder can make an intermediate molded product which has a well moldability and a high packing density and does not substantially shrink when sintered. Therefore, the powder of this invention enables the economical and efficient manufacture of a sintered product having a high sintered density and a high dimensional accuracy.

It is another object of this invention to provide an improved process for making a sintered metal product.

Other features and advantages of this invention will be apparent from the following description and the accompanying drawing.

DETAILED DESCRIPTION OF THE INVENTION

Figure 1:
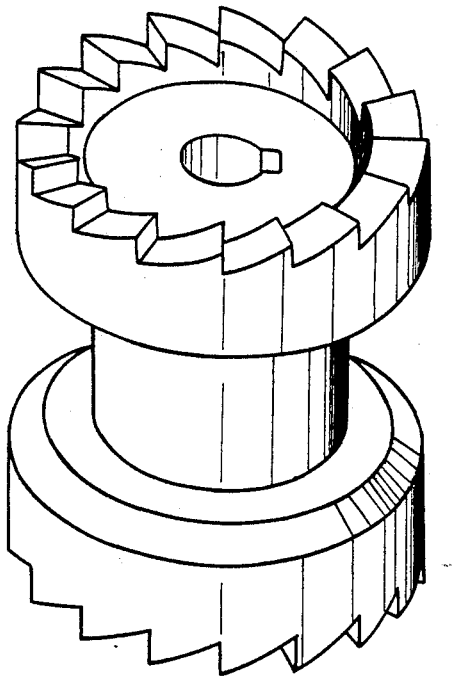
FIG. 1 is a perspective view of a sintered gear product manufactured from the metal powder of this invention.

The sintering metal powder of this invention consists of metal particles having a specific particle diameter distribution as hereinabove described.

The term "metal powder" as herein used means the powder of a pure metal, an alloy, a composite or mixture of at least one ceramic metal compound, such as a metal carbide, nitride or boride, and at least one metal or alloy. The particles of which the powder of this invention consists preferably have a round or polygonal shape which is not very irregular, though there is no particular limitation to their shape.

The particle diameter distribution of the powder is the distribution by weight of particles having different diameters. It is expressed by a curve defined by the weight of particles plotted along the ordinate axis and the particle diameter plotted along the abscissa axis. The class intervals of the particle diameter distribution are so determined that the common logarithms of the upper and lower limits thereof have a substantially fixed difference of, say, about 0.1. The weight of the particles having a particular diameter is shown as the height of the corresponding point on the distribution curve. The particle diameter can be measured by employing, for example, a commercially available coulter counter, microtrack, or sedimeter.

The particle diameter distribution of the powder according to this invention is represented by a curve having two or more peaks. Any adjoining two of the peaks have the following relations with respect to particle diameter and height:

(a) One of the particle diameters which is larger than the other has a ratio of between 5 and 10 to the other;

(b) The height of one of the peaks has a ratio of between 1 and 5 to that of the other that is not higher than the one peak;

(c) The particle diameter of one of the peaks which is not higher than the other is smaller than that of the other peak; and (d) The particle diameter at the highest peak is between 30 and 80 microns.

The powder having the particle diameter distribution satisfying the requirements as stated at (a) to (c) above achieves a remarkably increased maximum packing density in its mixture with the binder and thereby a greatly improved packing density in an injection or otherwise molded intermediate product. Therefore, the intermediate product has a minimal shrinkage when sintered and yields a sintered metal product having not only a high dimensional accuracy, but also high density and mechanical properties.

The particle diameter at the highest peak need to be between 30 and 80 microns, as stated at (d) above. If it is smaller than 30 microns, a long time is required for removing the binder, and moreover, the powder is expensive. If it exceeds 80 microns, only a product having a low sintered density can be obtained, and the sintered product has also a low dimensional accuracy due to the failure of the intermediate molded product to retain its shape satisfactorily when the binder is removed from it. The restriction of the particle diameter at the highest peak to the range between 30 and 80 microns means that the powder of this invention contains only a very small amount of particles having a diameter not exceeding 10 microns, or even no such particles, and is, therefore, inexpensive.

The process in which the metal powder of this invention is used to make a sintered metal product does not differ from the conventional processes in which a sintered metal product is manufactured from an intermediate product molded from a mixture of powder and binder.

Description will now be made by way of example with reference to the case in which injection molding is employed for making an intermediate molded product. A metal powder is mixed with an appropriate binder to form a uniform mixture containing an appropriate proportion of powder. The mixture is injection molded to make an intermediate molded product having a desired shape and the binder is removed from it by heating or solvent extraction. Then, it is sintered. The following is a detailed description of each of these steps:

PREPARATION OF THE MIXTURE

The binder which is used to prepare a mixture for injection molding may be selected from a wide variety of conventionally available types of binders, including a binder consisting of low-molecular polypropylene, partially saponified montan wax and dibutyl phthalate, a binder consisting of paraffin wax, ethylene acrylate, polyethylene and mineral oil, a binder consisting of partially saponified montan wax, polyethylene and stearic acid, and a binder consisting of polyethylene, methacrylic ester polymer, dibutyl phthalate and paraffin wax. A binder consisting of 20 to 70% by weight of paraffin wax, 20 to 70% by weight of low-density polyethylene and 5 to 20% by weight of boric ester is, among others, recommended, since it is easy to mix with a metal powder to form a mixture which can be injection molded easily to make an intermediate molded product having high strength and shape retainability, and particularly since it can be removed easily by a short time of heating treatment at a relatively low temperature.

The binder may contain stearic acid. It facilitates the release of the intermediate molded product from the mold. The binder may, however, not contain more than 20% by weight of stearic acid. A binder containing more than 20% by weight of stearic acid is less easy to mix with the metal powder.

The mixture preferably consists of 30 to 70% by volume of metal powder and 30 to 70% by volume of binder. If the binder is of the preferred composition as hereinabove stated, its proportion can be reduced to the range of 25 to 40% by volume, while the mixture can contain 60 to 75% by volume of powder. If the proportion of the powder is smaller than 30% by volume, it has too low a packing density in the intermediate molded product to yield a sintered product of improved density. A mixture containing more than 70% by volume of powder has a very low degree of injection moldability.

INJECTION MOLDING

Any apparatus that is conventionally used for the injection molding of plastics can be used for injection molding the mixture into an intermediate molded product. A temperature of 80° to 200° C. and an injection pressure of 500 to 2000 kg/cm$^2$ can usually be employed.

BINDER REMOVAL

The binder can be removed from the intermediate molded product if it is heated to a temperature of 240° to 550° C. at a heating rate of, say, 5° to 30° C. per hour in a furnace containing an inert gas or reducing atmosphere.

If the binder is of the preferred composition as hereinabove described, it is sufficient to heat the intermediate molded product to a relatively low temperature in the vicinity of 250° C. at a rate of at least 12° C. per hour and, if required, to hold it at that temperature. Therefore, the use of the binder of the preferred composition enables an improvement in the efficiency of binder removal and a reduction in the consumption of energy which is required for that purpose. This binder can alternatively be removed by a solvent degreasing method, i.e. if the intermediate molded product is dipped in an organic solvent containing chlorine, or a solvent such as tetrahydrofuran.

The low-density polyethylene and paraffin wax in the binder can both be removed virtually completely by vaporization if the intermediate molded product is heated. It is alternatively possible to remove the paraffin wax by dissolving it in a solvent, while the remaining low-density polyethylene is removed by vaporization when the intermediate molded product is sintered.

SINTERING

The intermediate molded product is sintered under the same conditions as those employed in an ordinary process of powder metallurgy. It is heated in a furnace containing an inert or reducing gas atmosphere, or a vacuum heating furnace, to the sintering temperature which depends on the metal powder employed.

The invention will now be described more specifically with reference to examples. In the following description, Runs #1 to 10 refer to comparative examples, and Runs #11 to 14 mean examples of this invention. All the intermediate molded products were made by injection molding.

COMPARATIVE EXAMPLES (RUNS #1 TO 10) AND EXAMPLES (RUNS #11 TO 14)

Eight kinds of metal powders were prepared for use in these examples. Each powder had a particle diameter distribution having a single peak. They were five kinds of iron powder having peak particle diameters of 80, 45, 15, 6 and 0.8 micron, respectively, and three kinds of SUS316L stainless steel powders having peak particle diameter of 45, 15 and 6 micron, respectively. The iron powder having a peak particle diameter of 80 micron was prepared by a water atomizing method and had a particle diameter distribution which was substantially normal to the logarithms of the particle diameters. The iron powders having peak particle diameters of 45 and 15 micron were each obtained by sieving the powder having a peak particle diameter of 80 microns. The iron powders having peak particle diameters of 6 and 0.8 micron were each prepared by a carbonyl method and had a sharp particle diameter distribution. The three kinds of stainless steel powders were prepared by classifying the powder which had been obtained by a water atomizing method.

Six kinds of the above-mentioned powders were used for Runs #1 to 5 and 9, respectively, as shown in TABLE 1, while two or three kinds of the above-mentioned powders were mixed, as shown in TABLE 1, to prepare powders for Runs #6 to 8 and 10 to 14. The particle diameter distribution of each mixed powder was analyzed by a coulter counter and the peak position and peak height ratio thereof were substantially as shown in TABLE 1. Each Run powder (or mixed powder) was examined for maximum packing density by a vibrating method. The results are shown in TABLE 1 wherein the theoretical density is 100%.

Each powder was kneaded with a binder consisting of 60% by weight of paraffin wax having a softening point of 70° C., 20% by weight of low-density polyethylene having a fluidity of 200 g/10 min. and 20% by weight of a boric ester dispersant (W-905product of the West German company, BYK-Mallinkrodt) to prepare a mixture for injection molding. The mixture was injection molded into an intermediate molded product in the shape of a rectangular parallelopiped measuring 10 mm square and 50 mm long.

The intermediate molded product was heated at a temperature of 250° C. in a furnace containing a nitrogen gas atmosphere, whereby the binder was removed from it. Then, it was sintered in a vacuum heating furnace for one hour. The intermediate products comprising iron powder (Runs #1 to 8 and 11 to 13) were sintered at 1250° C., while those comprising stainless steel powder (Runs #9, 10 and 14) were sintered at 1300° C.

Each of the sintered metal products was examined for sintered density in accordance with the method of JIS z 2505, and also for the volume shrinkage which had occurred from the intermediate product to the sintered product. The results are shown in TABLE 1, in which the sintered density of each product is shown on the basis of the theoretical density of 100%.

For the sake of information, TABLE 1 also shows the cost of the powder (or mixed powder) used in each Run as compared with the price per unit weight of a powder of the same material having a peak particle diameter of 6 microns, which is shown as 100. The comparison was based on the prices prevailing in 1988.

All of the sintered products comprising stainless steel powder were analyzed for carbon. They had a carbon content of 0.02% by weight falling within the standard range.

As is obvious from TABLE 1, the powders having a single peak particle diameter exceeding 10 micron (Runs #1 to 3 and 9) yielded the products having a low sintered density in the neighborhood of 80% and lacking in the compactness, though they were very inexpensive, and the powders having a single peak particle diameter which was smaller than 10 microns (Runs #4 and 5) yielded the products apparently having an undesirably low dimensional accuracy as evidenced by the volume shrinkages of 43 and 63%, respectively, though they had a high sintered density exceeding 90%.

The powders deviating from the scope of this invention did not yield any desirable sintered product, though they had two or three peak particle diameters, as is obvious from Runs #6 to 8 and 10 in which the products had a low sintered density (Run #7; 85%, and Run #10: 83%), and from Runs #6 to 9 in which the products showed a relatively high degree of shrinkage in the range of 31 to 35%. On the other

TABLE 1

| Run # | Material | Peak particle diameter 80 μm | 45 μm | 15 μm | 6 μm | 0.8 μm | Peak particle diameter ratio | Peak height ratio | Max. packing density | Amount of binder | Sintered density | Volume shrinkage | Powder cost ratio |
|---|---|---|---|---|---|---|---|---|---|---|---|---|---|
| Comparative Example | | | | | | | | | | | | | |
| 1 | Iron | 100 parts | — | — | — | — | — | — | 45.6% | 56 vol. % | 78% | 35% | 8 |
| 2 | Iron | — | 100 | — | — | — | — | — | 50.1% | 52 vol. % | 82% | 34% | 15 |
| 3 | Iron | — | — | 100 | — | — | — | — | 52.8% | 51 vol. % | 87% | 37% | 50 |
| 4 | Iron | — | — | — | 100 | — | — | — | 53.2% | 50 vol. % | 92% | 43% | 100 |
| 5 | Iron | — | — | — | — | 100 | — | — | 37.4% | 66 vol. % | 96% | 63% | 500 |
| 6 | Iron | 50 parts | — | — | 50 | — | 13.3 | 1.0 | 58.6% | 43 vol. % | 88% | 32% | 54 |
| 7 | Iron | — | 70 | 30 | — | — | 3.0 | 2.3 | 52.5% | 50 vol. % | 85% | 35% | 25 |
| | | | | | | | 3.0 | 1.8 | | | | | |
| 8 | Iron | — | 55 | 30 | 15 | — | 2.5 | 2.0 | 58.8% | 44 vol. % | 90% | 34% | 38 |
| 9 | SUS316L | — | 100 | — | — | — | — | — | 51.0% | 52 vol. % | 79% | 31% | 33* |
| 10 | SUS316L | — | 70 | 30 | — | — | 3.0 | 2.3 | 52.7% | 51 vol. % | 83% | 34% | 53* |
| Example | | | | | | | | | | | | | |
| 11 | Iron | 70 parts | — | 30 | — | — | 5.3 | 2.3 | 68.7% | 33 vol. % | 87% | 21% | 20 |
| 12 | Iron | — | 66 | — | 34 | — | 7.5 | 1.9 | 70.3% | 32 vol. % | 91% | 24% | 44 |
| 13 | Iron | — | 55 | — | 30 | 15 | 7.5 | 1.8 | 74.2% | 30 vol. % | 94% | 25% | 113 |

TABLE 1-continued

| Run # | Material | Peak particle diameter 80 μm | 45 μm | 15 μm | 6 μm | 0.8 μm | Peak particle diameter ratio | Peak height ratio | Max. packing density | Amount of binder | Sintered density | Volume shrinkage | Powder cost ratio |
|---|---|---|---|---|---|---|---|---|---|---|---|---|---|
| | | | | | | | 7.5 | 2.0 | | | | | |
| 14 | SUS316L | — | 66 | — | 34 | — | 7.5 | 1.9 | 72.4% | 31 vol. % | 92% | 22% | 101* |

*Ratio to the price of powder having a particle diameter of 15 μm considered as 100.

hand, the powders according to this invention yielded the products having a fairly high sintered density in the range of 87 to 94% and an extremely low degree of volume shrinkage in the range of 21 to 25% (Runs #11 to 14).

Moreover, the powders according to this invention showed a packing density of 68.7 to 74.2% in the intermediate molded products (Runs #11 to 14), which was by far higher than the range of 37.4 to 58.8% which was shown by the powders according to the comparative examples (Runs #1 to 10).

These results confirm that the metal powder of this invention can yield a sintered product having high density and dimensional accuracy from an intermediate molded product.

EXAMPLE 15

A mixture for injection molding was prepared by kneading 68% by volume of the metal powder according to this invention as shown at Run #12 with 32% by volume of a binder consisting of 70% by weight of paraffin wax having a softening point of 70° C., 20% by weight of low-density polyethylene having a fluidity of 200 g/10 min and 10% by weight of a boric ester dispersant. The mixture was injection molded into a gear as shown in FIG. 1. The injection molded product was subjected to a binder removing treatment by dipping in carbon tetrachloride at room temperature for eight hours. Then, it was dried and weighed. Its reduction in weight confirmed that more than 90% by weight of paraffin wax had been removed. The molded product from which the binder had been removed still retained a very good appearance free of any deformation.

It was sintered for one hour in a vacuum heating furnace and yielded a good sintered gear.

EXAMPLES 16 TO 25

Sintered products each in the form of a gear as shown in FIG. 1 were made by using the powders according to Runs #12, 13 and 14 and binders having different compositions as shown in TABLE 2.

In each example, the powder was kneaded with the binder in the amount as shown in TABLE 2, and the mixture was injection molded into the gear shape as shown in FIG. 1. Its injection moldability was as shown in TABLE 2, while the maximum packing density of the powder, the sintered density and volume shrinkage of the sintered product were equal to the results shown in TABLE 1 for Run #12, 13 or 14.

The injection molded product was subjected to a binder removing treatment by heating in a nitrogen gas atmosphere until the binder remaining in it was reduced to not more than 2% by weight. The product from which the binder had been removed retained a good appearance as shown in TABLE 2, which shows also the temperature and time which had been employed for the binder removal.

Each molded product having a good appearance was sintered for one hour in a vacuum at a temperature of 1250° C. if it had been prepared from the power according to Run #12 and 13, or at 1300° C. if it had been prepared from the powder according to Run #14. All of them yielded good sintered products.

TABLE 2

| Run # | Powder # | Binder Composition (wt. %) | | Amount (vol. %) | Injection moldability | Binder removal Temperature | Time | Appearance |
|---|---|---|---|---|---|---|---|---|
| Example | | | | | | | | |
| 16 | 12 | Low molecular polypropylene | 60% | 44% | Substantially good | 500° C. | 70 h | Good |
| | | Partially saponified montan wax | 15% | | | | | |
| | | Dibutyl phthalate | 25% | | | | | |
| 17 | 12 | Paraffin wax | 90% | 38% | Substantially good | 350° C. | 30 h | Good |
| | | Ethylene acrylate | 3% | | | | | |
| | | Polyethylene having a fluidity of 50 | 5% | | | | | |
| | | Mineral oil | 2% | | | | | |
| 18 | 12 | Partially saponified montan wax | 70% | 34% | Substantially good | 500° C. | 70 h | Good |
| | | Polyethylene having a fluidity of 200 | 20% | | | | | |
| | | Stearic acid | 10% | | | | | |
| 19 | 14 | Polyethylene having a fluidity of 100 | 40% | 42% | Good | 450° C. | 58 h | Good |
| | | Methacrylic ester polymer | 25% | | | | | |
| | | Dibutyl phthalate | 10% | | | | | |
| | | Paraffin wax | 25% | | | | | |
| 20 | 12 | Paraffin wax | 60% | 32% | Good | 250° C. | 16 h | Good |
| | | Polyethylene having a fluidity of 200 | 20% | | | | | |
| | | Boric ester dispersant | 20% | | | | | |
| 21 | 2 | Paraffin wax | 40% | 34% | Good | 300° C. | 24 h | Good |
| | | Polyethylene having a fluidity of 250 | 40% | | | | | |
| | | Boric ester dispersant | 20% | | | | | |
| 22 | 14 | Paraffin wax | 50% | 34% | Good | 300° C. | 24 h | Good |
| | | Polyethelene having a fluidity of 180 | 40% | | | | | |
| | | Boric ester dispersant | 10% | | | | | |
| 23 | 14 | Paraffin wax | 70% | 32% | Good | 250° C. | 16 h | Good |
| | | Polyethylene having a fluidity of 200 | 20% | | | | | |
| | | Boric ester dispersant | 10% | | | | | |
| 24 | 12 | Paraffin wax | 60% | 32% | Good | 250° C. | 16 h | Good |

TABLE 2-continued

| Run # | Powder # | Binder Composition (wt. %) | | Amount (vol. %) | Injection moldability | Binder removal Temperature | Binder removal Time | Appearance |
|---|---|---|---|---|---|---|---|---|
| | | Polyethylene having a fluidity of 200 | 20% | | | | | |
| | | Boric ester dispersant | 15% | | | | | |
| | | Stearic acid | 5% | | | | | |
| 25 | 13 | Paraffin wax | 60% | 29% | Good | 250° C. | 20 h | Good |
| | | Polyethylene having a fluidity of 200 | 20% | | | | | |
| | | Boric ester dispersant | 20% | | | | | |

What is claimed is:

1. A sintering metal powder consisting of metal particles having a particle diameter distribution including a plurality of peaks and having the following characteristics:

(a) The larger of the two particle diameters defining every adjoining two of said peaks has a ratio of between 5 and 10 to the smaller;

(b) The height of one of every adjoining two of said peaks has a ratio of between 1 and 5 to that of the other that is not higher than said one peak;

(c) The particle diameter defining one of every adjoining two of said peaks which is not higher than the other is smaller than that defining said other peak; and (d) The particle diameter defining the highest of said peaks is between 30 and 80 microns.

2. A powder as set forth in claim 1, wherein said particles have a round or polygonal shape.

3. A process for making a sintered metal product comprising:

preparing a mixture of (i) a metal powder consisting of metal particles having a particle diameter distribution including a plurality of peaks and having the following characteristics:

(a) The larger of the two particle diameters defining every adjoining two of said peaks has a ratio of between 5 and 10 to the smaller;

(b) The height of one of every adjoining two of said peaks has a ratio of between 1 and 5 to that of the other that is not higher than said one peak;

(c) The particle diameter defining one of every adjoining two of said peaks which is not higher than the other is smaller than that defining said other peak; and (d) The particle diameter defining the highest of said peaks is between 30 and 80 microns, and (ii) a binder;

molding said mixture into an intermediate product and removing said binder from said intermediate product; and sintering said intermediate product.

4. A process as set forth in claim 3, wherein said binder comprises 20 to 70% by weight of paraffin wax, 20 to 70% by weight of low-density polyethylene and 5 to 20% by weight of boric ester, and wherein said intermediate product is made by injection molding.

5. A process as set forth in claim 4, wherein said binder further contains not more than 20% by weight of stearic acid.

6. A process as set forth in claim 3, wherein said mixture comprises 30 to 70% by volume of said powder and 30 to 70% by volume of said binder.

7. A process as set forth in claim 4, wherein said mixture comprises 60 to 75% by volume of said powder and 25 to 40% by volume of said binder.

8. A process as set forth in claim 3, wherein said intermediate product is made by injection molding at a temperature of 80° to 200° C. and an injection pressure of 500 to 2000 kg/cm$^2$.

9. A process as set forth in claim 3, wherein said binder is removed by heating said intermediate product to a temperature of 240° to 550° C. at a heating rate of 5° to 30° C. per hour in a furnace containing an inert or reducing gas atmosphere.

10. A process as set forth in claim 4, wherein said binder is removed by heating said intermediate product to a temperature of up to about 250° C. at a heating rate of at least 12° C. per hour in a furnace containing an inert or reducing gas atmosphere.

11. A process as set forth in claim 3, wherein said binder is removed by dipping said intermediate product in a solvent.

12. A process as set forth in claim 3, wherein said sintering is performed in a furnace containing an inert or reducing gas atmosphere, or a vacuum heating furnace.

13. A sintered metal product made by a process as set forth in any of claims 3 to 12.

* * * * *